US005784834A

United States Patent [19]

Stutzman

[11] Patent Number: 5,784,834

[45] Date of Patent: Jul. 28, 1998

[54] DOOR SEAL

[76] Inventor: Ellis D. Stutzman, 8070 Meade, Westminster, Colo. 80030

[21] Appl. No.: 775,969

[22] Filed: Jan. 3, 1997

[51] Int. Cl.[6] ..... E06B 7/16

[52] U.S. Cl. ..... 49/475.1; 49/496.1; 49/197

[58] Field of Search ..... 49/475.1, 496.1, 49/197, 198, 199, 498.1, 201, 202, 203, 204, 205, 206

[56] References Cited

U.S. PATENT DOCUMENTS

| | | | |
|---|---|---|---|
| 4,525,953 | 7/1985 | Stutzman . | |
| 4,957,301 | 9/1990 | Clay et al. | 49/496.1 X |
| 5,101,598 | 4/1992 | Fujihira | 49/498.1 |
| 5,347,759 | 9/1994 | Kobayashi et al. | 49/496.1 |
| 5,435,104 | 7/1995 | Dietrich | 49/475.1 X |

*Primary Examiner*—Jerry Redman
*Attorney, Agent, or Firm*—Ancel W. Lewis, Jr.

[57] ABSTRACT

A door seal particularly suitable for garage doors disclosed has a rigid base portion made of a plastic material that is fastened to a support frame surrounding a door and a flexible combination cover and flap portion made of a plastic material that is integral with and preferably coextruded with the base portion. The cover and flap portion extend over outer front end and rear end faces of the base portion. The flap extends at an angle from a front corner along the outer face of the base portion. The flap extends forwardly and outwardly at an angle beyond the front end face of the base portion so as to be engaged and be flexed by the garage door in the closed position and in sealed engagement with the door when the door is closed.

14 Claims, 2 Drawing Sheets

DOOR SEAL

TECHNICAL FIELD

This invention relates to seals that mount on the frame of a door to form a seal between the frame and door and more particularly to a plastic door seal that is particularly suitable for extending around the perimeter of an overhead garage door.

BACKGROUND ART

Some attempts have been made to provide door seals for garage doors which keep out the air and form a pleasing appearance.

In U.S. Pat. No. 4,525,953 of the same inventor wherein there is shown a wooden door seal having a strip of wood with a flexible flap mounted in a groove cut at an angle in the strip of wood. The plastic door seal of the present invention is believed to overcome many of the disadvantages of forming such devices by wood including the problems of warping and painting.

DISCLOSURE OF THE INVENTION

A plastic door seal that extends around the perimeter of the door frame of particularly a garage door and engages the door in the closed position to form a seal. The door seal disclosed includes a straight elongated base portion that is rigid, hollow and of plastic having a rectangular cross section together with an outer cover and seal portion coextensive with the base portion made of a flexible layer of plastic. The cover and seal portion having a flexible flap that extends forwardly and laterally at an angle to an outer wall at the front of the base portion. The base portion and cover and seal portion preferably are coextruded with the base portion providing rigidity and the flap being flexible to move between door open and door closed positions to provide a seal when the door is closed and providing a desired exterior color.

BRIEF DESCRIPTION OF THE DRAWINGS

Details of this invention are described in connection with the accompanying drawings which like parts bear similar reference numerals in which.

DETAILED DESCRIPTION

Figure 1:
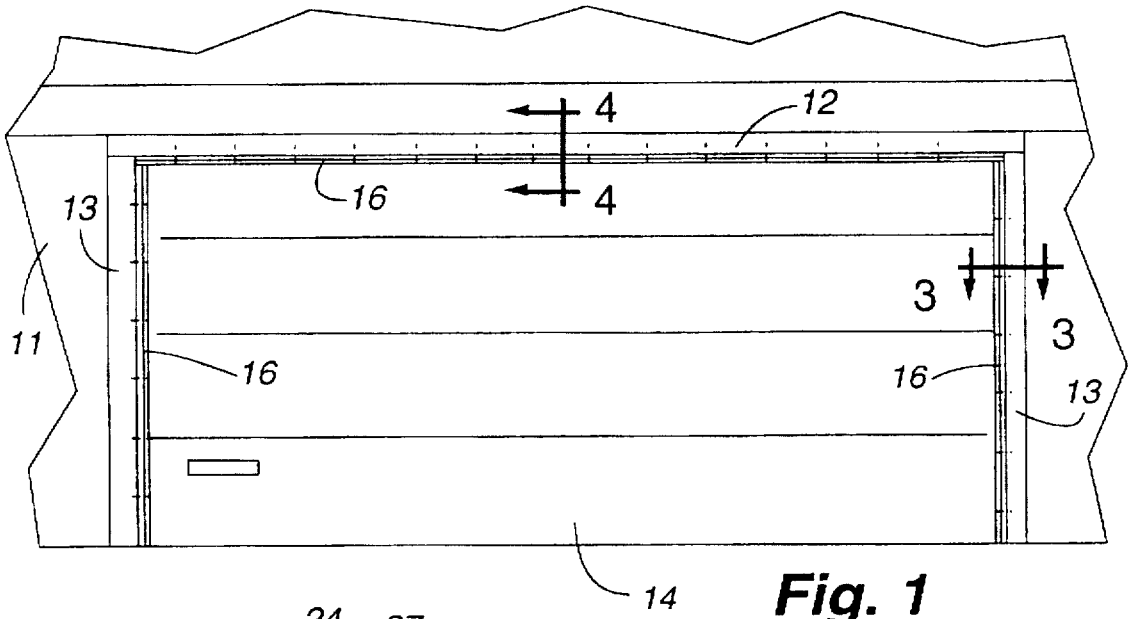
FIG. 1 is a front elevation view of a portion of a garage and garage door with a door seal embodying features of the present invention installed with the door shown in a closed position.
Figure 2:
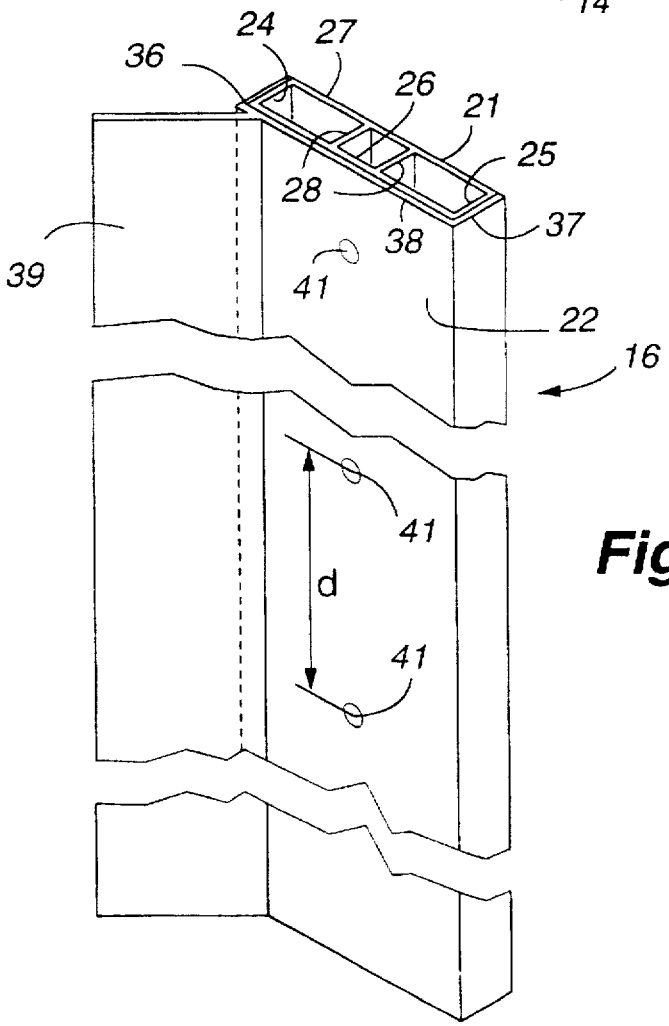
FIG. 2 is a perspective view of the door seal shown in FIG. 1.

Referring now to FIG. 1 there is shown a portion of a garage 11 including a door frame having a top beam 12 and opposed spaced side beams 13 with a movable door 14 arranged to move between the closed position as shown and an open position together with the door seal 16 embodying features of the present invention secured in place along the top beam 12 and along both side beams 13. Each door seal 16 is of a selected length such as seven feet, eight feet, nine feet, ten feet, twelve feet, fourteen feet, sixteen feet and eighteen feet to meet the requirements of a particular garage door size.

The door seal 16, broadly stated, includes a base portion 21 and a combination cover and seal portion 22 that is coextensive with the base portion 21. The base portion 21 is a hollow, rigid, straight, elongated body made of a plastic material and has a rectangular cross section having a front end wall 24, rear end wall 25, outer wall 26 and inner wall 27 together with two spaced intermediate walls 28 extending parallel to the front and rear end walls 24, 25 and connected at the ends to the outer and inner walls 26, 27. The intermediate walls 28 are on opposite sides and fixed distances from a longitudinal center line of the base portion 21. The front end wall 24 has an outer front face 31, the rear end wall 25 has an outer rear face 32, the outer wall 26 has an outer face 33 and the inner wall 27 has an outer face 34.

The cover and seal portion 22 is a flexible cover layer including a front layer section 36 that extends along and is bonded to the outer front face 31, a rear layer section 37 that extends along and is bonded to outer rear face 32 of the base portion and an outer layer section 38 that extends along and is bonded to outer face 33. A flexible flap 39 that extends at an angle designated A to the outer surface 33 of preferably 45 degrees. A series of apertures or holes 41 are provided at selected spaced intervals designated D and are located at the center of the base portion between intermediate walls 28 so that a fastener 42 such as a nail can be driven through each hole and into the support beams. The cover and seal portion 22 is a flexible plastic material. A preferred method of manufacture is to coextrude the base portion 21 and cover and seal portion 22 so they become a unitary or integral body. A die or pigment such as white is added to provide a selected color for portion 22 to match the paint color of the beam to which it is attached and the color of the garage door.

Figure 3:
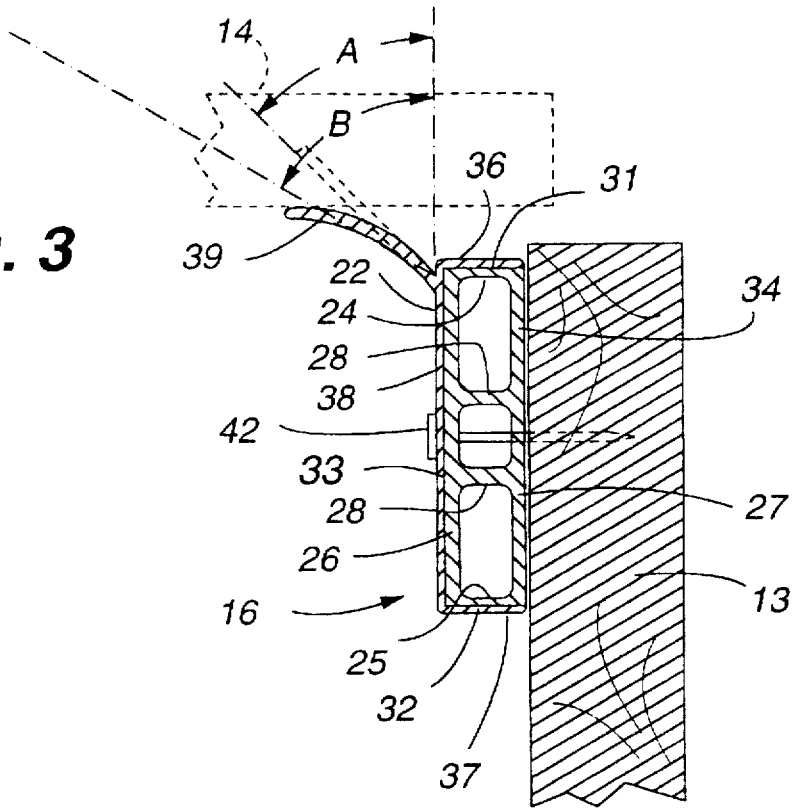
FIG. 3 is a sectional view taken along line 3—3 of FIG. 1.
Figure 4:
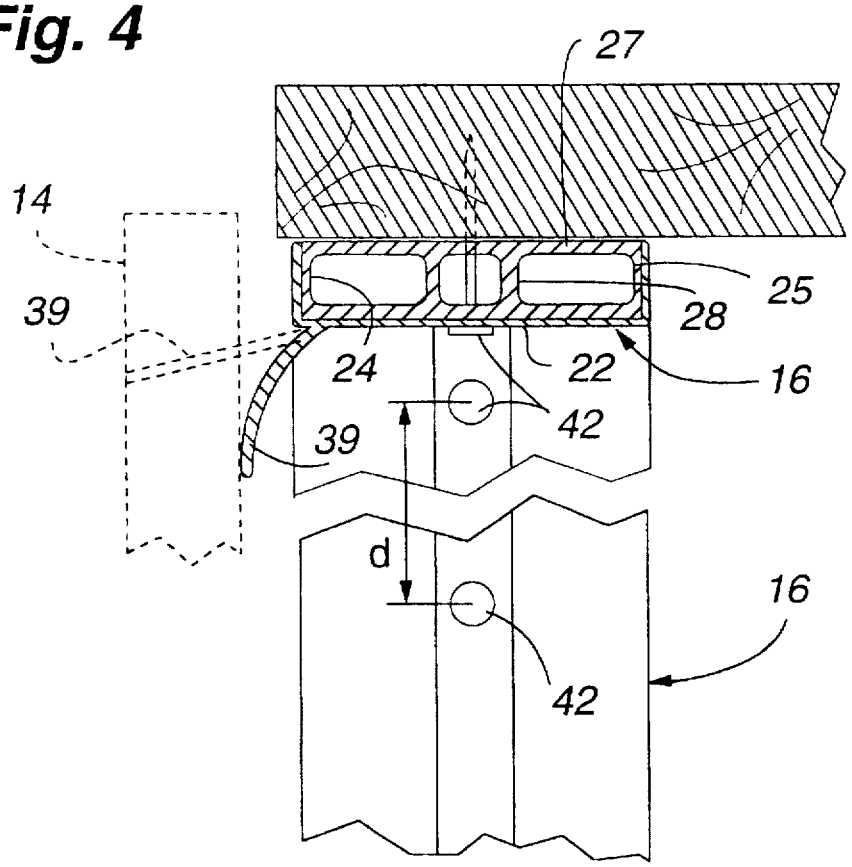
FIG. 4 is sectional view taken along line 4—4 of FIG. 1.

In installation the front layer section 36 is inset approximately an eighth of an inch from the end of the beam. The outer surface of the rear wall 27 butts up flush against the outer surface of the beam to which it is fastened and when the door comes against the flap 39 it is moved from an angle of preferably 45 degrees to an angle designated B of about 55–65 degrees as shown in FIGS. 3 and 4. The door seal 16 that extends along the top beam is for the full length of the beam and overlaps a part of the seal that extends along the side beams 13.

By way of example and not limitation, a material found suitable for the preferred embodiment disclosed had the following properties:

| ASTM No. | Property | Value |
|---|---|---|
| | Portion 21 - GEON 87416 | |
| D 2240 | hardness | 82 durometer |
| D 638 | tensile strength | 6400 psi |
| D 790 | modulus | 430,000 psi |
| D 792 | specific gravity | 1.45 |
| D 790 | flexural strength | 12,300 psi |
| | Portion 22 - NORAPLAS 8745 | |
| D 2240 | hardness | 75 durometer |
| D 412 | tensile strength | 2000 psi |
| D 412 | modulus | 775 psi |
| D 792 | specific gravity | 1.38 |
| D 412 | elongation | 350% |

The device disclosed is of approximately 75% GEON® 87416 and 25% NORAPLAS® 8745 by weight.

Advantages of the plastic materials over wood are that they are straight, do not warp and do not require frequent painting.

Although the present invention has been described with a certain degree of particularity, it is understood that the present disclosure has been made by way of example and that changes in details of structure may be made without departing from the spirit thereof.

What is claimed is:

1. A door seal for sealing a gap between a garage door and a garage door frame comprising:

a hollow, rigid base portion having an outer face, an inner face, a front end face, and a rear end face, said inner face being adapted for mounting to the garage door frame, said base portion being made of a rigid first compound of a plastic material and extruded, said base portion having a front end wall, a rear end wall, an outer wall and an inner wall arranged as a rectangle and a pair of spaced intermediate walls spaced from and inwardly of said front and rear end walls and connected to said outer and inner walls, and a flexible combination cover and seal portion secured to and extending at least only over said outer face and said rear end face, said cover and seal portion having a flap adapted for engaging the garage door when the garage door is closed and sealing the gap between the garage door and garage door frame, said flap extending at an angle from said outer face, said cover and seal portion being made of a flexible second compound of said plastic material and coextruded with said base portion to form an integral unit with said base portion, and a plurality of apertures at spaced intervals along and extending through said outer and inner walls between said intermediate walls to receive fasteners to secure a base portion to said door frame beam.

2. A door seal as set forth in claim 1 wherein said plastic material is polyvinyl chloride.

3. A door seal as set forth in claim 1 wherein said base portion has a hardness of about 82 durometer.

4. A door seal as set forth in claim 1 wherein said base portion has a tensile strength of about 6400 psi.

5. A door seal as set forth in claim 1 wherein said base portion has a modulus of about 43,000 psi.

6. A door seal as set forth in claim 1 wherein said base portion has a flexural strength of about 12,300 psi.

7. A door seal as set forth in claim 1 wherein said first angle is about 45 degrees and said second angle is about 45–65 degrees.

8. A door seal as set forth in claim 1 wherein said cover and seal portion are made of a polyvinyl chloride material.

9. A door seal as set forth in claim 1 wherein said cover and seal portion has a hardness of about 75 durometer.

10. A door seal as set forth in claim 1 wherein said cover and seal portion has a tensile strength of about 2000 psi.

11. A door seal as set forth in claim 1 wherein said cover and seal portion has a modulus of about 775 psi.

12. A door seal as set forth in claim 1 wherein said cover and seal portion has an elongation of about 350%.

13. A door seal as set forth in claim 1 wherein said base portion is approximately 75% and said cover and seal portion about 25% by weight.

14. A door seal as set forth in claim 1 wherein said cover and seal portion has a color to match the color of a structure to which said seal is attached.

* * * * *

UNITED STATES PATENT AND TRADEMARK OFFICE

CERTIFICATE OF CORRECTION

PATENT NO. : 5,784,834
DATED : July 28, 1998
INVENTOR(S) : Ellis D. Stutzman

It is certified that error appears in the above-identified patent and that said Letters Patent is hereby corrected as shown below:

Column 3,
Line 31, change "a" to -- said --.

Signed and Sealed this

Second Day of May, 2006

JON W. DUDAS
*Director of the United States Patent and Trademark Office*

UNITED STATES PATENT AND TRADEMARK OFFICE

CERTIFICATE OF CORRECTION

PATENT NO. : 5,784,834
APPLICATION NO. : 08/775969
DATED : July 28, 1998
INVENTOR(S) : Ellis D. Stutzman It is certified that error appears in the above-identified patent and that said Letters Patent is hereby corrected as shown below:

Column 3,
Line 32, change "said" to -- a --.

Signed and Sealed this

Twentieth Day of June, 2006

JON W. DUDAS
*Director of the United States Patent and Trademark Office*